United States Patent [19]

LaGrone et al.

[11] 4,118,137

[45] Oct. 3, 1978

[54] PAVEMENT AND PROCESS OF PROVIDING THE SAME

[75] Inventors: Bobby D. LaGrone; Bobby J. Huff, both of Vicksburg, Miss.

[73] Assignee: U.S. Rubber Reclaiming Co., Inc., Vicksburg, Miss.

[21] Appl. No.: 747,528

[22] Filed: Dec. 6, 1976

[51] Int. Cl.[2] ..... E01C 7/36

[52] U.S. Cl. ..... 404/76; 404/17; 404/31

[58] Field of Search ..... 404/76, 32, 31, 28, 404/82, 72, 17

[56] References Cited

U.S. PATENT DOCUMENTS

| | | | |
|---|---|---|---|
| 1,507,282 | 9/1924 | Hammatt | 404/28 |
| 1,588,926 | 6/1926 | Williams | 404/32 |
| 1,940,528 | 12/1933 | Bond | 404/32 X |
| 2,083,900 | 6/1937 | Ebberts | 404/31 |
| 2,413,901 | 1/1947 | Abernathy | 404/32 X |
| 2,977,864 | 4/1961 | Pullar | 404/32 X |
| 3,112,681 | 12/1963 | Gessler | 404/31 |
| 3,603,221 | 9/1971 | Barton | 404/31 |
| 3,930,100 | 12/1975 | McDonald | 404/32 X |

*Primary Examiner*—Nile C. Byers
*Attorney, Agent, or Firm*—Robert E. Burns; Emmanuel J. Lobato; Bruce L. Adams

[57] ABSTRACT

A portland-cement stabilized soil base for a roadway is covered with an elastic rubber-asphalt layer and thereafter with a surfacing layer. The elastic layer may be formed by reacting 1 to 30% by weight of asphalt with 99-70% by weight of rubber and be applied hot as by spraying; and the surfacing layer will ordinarily be asphalt concrete composed of asphalt binding aggregate particle such as coarse stone, together. Preferably the elastic layer covered with a layer to prevent bonding of the elastic layer with an overlying asphalt concrete layer. Such bonding-preventing layer may be finely crushed stone, roofing paper, non-woven fabric, or plastic film, or the like.

8 Claims, 4 Drawing Figures

PAVEMENT AND PROCESS OF PROVIDING THE SAME

FIELD OF THE INVENTION

This invention relates to pavements and processes for reducing surface cracking of overlays utilizing a portland-cement stabilized base.

DESCRIPTION OF THE PRIOR ART

The problem of providing a firm stable base for road construction is one that has always plagued the highway construction engineer. A suitable base can be constructed using crushed aggregate or naturally occurring mineral aggregates of many types, however there is almost always the problem of digging out the native stone, crushing it and getting it to the location where the road is to be built. The volume of base material used and weights of the material (and in some cases an actual lack of suitable mineral aggregate in a given area) makes construction of a highway base very expensive.

In 1935 a research program was undertaken by the Portland Cement Association to investigate the value of mixing small quantities of portland cement with the soil to harden it and provide a stable base for highway pavements. The success of this research has resulted in a steady increase in the use of the system to the point that there are now over 50,000,000 square yards of the soil cement mixture placed annually. This is equivalent to 3500 miles of 24 feet wide pavement. The popularity of this procedure is due to the fact that it enables the engineer to convert the native soil (in place) into a substitute for the expensive gravel or rock. This is especially valuable on roads with low traffic volumes where extremely high strength bases are not required.

The procedure used to incorporate the cement consists of loosening the soil, spreading dry portland cement over it, adding water, and mixing in place with special machines. The mixed material is compacted with rollers and sprayed with a bituminous material to seal in the moisture needed for even curing of the cement. After curing, this base is paved with asphalt concrete to produce the completed roadway.

The major drawback to the use of the portland cement stabilized base has been that environmental factors such as day-to-day temperature variations during the curing period, uneven temperatures throughout the soil cement layer, and infiltration of subsurface moisture often produce uneven curing of the material. This results in the formation of extensive shrinkage cracks in the surface of the base.

When the asphalt concrete is bonded to this surface, the tensile stresses created by this cracking are transmitted to the asphalt concrete surface course and the cracks reappear in the pavement surface. This reduces structural strength and allows water intrusion which eventually results in deterioration of the pavement and a subsequently shorter pavement life than could have been expected had this problem not existed.

A few exotic procedures, such as encapsulating the soil cement layer between plastic sheets, have been tried but this negates the economic advantage and practicality of the system. Consequently, highway engineers have had to accept this reflection cracking as a hazard to using the soil cement base.

Bynum and Gallaway in U.S. Pat. No. 3,707,901 proposed an interlayer system in which rubber, aggregate, and asphalt were mixed to form a composite layer to absorb the strains produced by an underlying cracked pavement. Since the rubber and asphalt were unreacted, the primary strain absorbing property was the resilience of the discrete rubber particles and it lacked the tensile properties necessary to absorb large strains. Problems encountered with installing their system has also limited its acceptance and use for this purpose.

SUMMARY OF THE INVENTION

With the foregoing problem in view, the present invention contemplates a pavement system in which a hot elastic rubber asphalt composition is sprayed (or squegeed) onto a soil/cement base to form an elastic membrane layer that will seal the cracks thus preventing moisture intrusion and will absorb the tensile stresses in the base by deforming elastically without breaking or transmitting sufficient strain to the asphalt concrete overlay to cause cracking of the overlay surface.

We have found that 0.2–1.0 gal. sq. yd. of an elastic rubber asphalt composition, prepared by reacting at an elevated temperature, from 1–30% by weight of a non oil resistant rubber and from 70–99% by weight of a melted asphalt cement, when applied to a portland cement stabilized road base will form an elastic membrane that will substantially reduce water intrusion and will prevent reflection cracking.

In a broader aspect of the invention, we have found that either virgin or reclaimed particulate rubber (as, for example, ground tire scrap, SBR, natural rubber - especially non-oil resistant rubber - and the like), can be reacted with a suitable asphalt cement at from 200° F. to 450° F. to form an elastic rubber-asphalt composition suitable for the purpose of this invention.

In certain aspects of the invention we have found that liquid rubber latex of either the oil-resistant or non-oil-resistant type, can be reacted with a hot asphalt cement to form a suitable composition for the purpose of this invention.

Once the elastic rubber-asphalt composition is produced, it can be sprayed, poured, rolled or squegeed onto the prepared road base to form the desired elastic layer. A coating of mineral aggregate may be applied to the rubber-asphalt elastic layer and rolled to produce a firm bond.

The purpose of the application of aggregate is to protect the rubber-asphalt layer from damage from pavers and from other sources of damage during the placement of subsequent pavement layers and to provide a "parting" effect which prevents bonding of the rubber asphalt layer to the overlying asphalt concrete. Such bonding could produce migration of the rubber asphalt into the asphalt concrete and/or produce transmission of lateral movement in the crack-prone base to the less flexible asphalt-concrete layer with subsequent deformation and cracking of the surface. Other parting materials, for example, roofing paper, nonwoven fabric, plastic sheeting, and the like may be used for this purpose.

The covered rubber-asphalt layer is itself covered with a layer of asphalt concrete of sufficient thickness to provide the desired strength and to protect the rubber asphalt layer from the wear of traffic.

BRIEF DESCRIPTION OF THE DRAWINGS

In FIG. 1 there is shown a road base 10 of soil stabilized by portand cement. This is overlain by an elastic membrane-like layer 11 comprising rubber and asphalt reacted in accordance with the invention. This is itself overlain by a parting layer 12 of finely crushed stone over which an ordinary asphalt concrete road surfacing 13 is laid.

In FIGS. 2, 3 and 4, the layers 10, 11 and 13 are similar but with other bonding inhibitors.

In FIG. 2, the layer 12*a* is composed of roofing paper;

In FIG. 3, the layer 12*b* is composed of unwoven fabric;

In FIG. 4, the layer 12*c* is composed of plastic in the form of a thin sheet or layer.

DETAILED DESCRIPTION OF THE INVENTION

EXAMPLE 1

Figure 1:
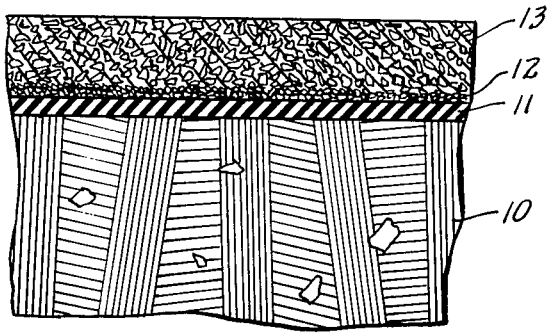
FIG. 1 is a fragmentary vertical section through a pavement embodying the invention.
Figure 2:
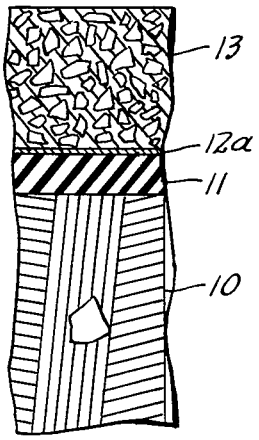
FIG. 2 is an enlarged detail view similar to FIG. 1 but showing another type of parting layer.
Figure 3:
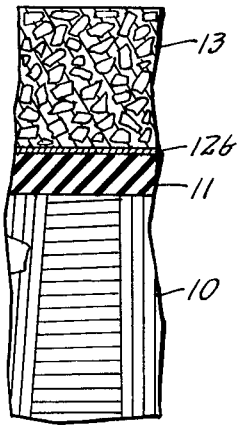
FIG. 3 is a similar view showing still another type of parting layer.
Figure 4:
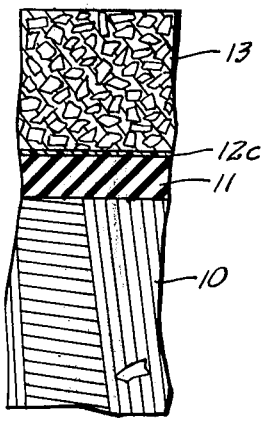
FIG. 4 is a similar view showing a third type of layer.

A hot rubberized asphalt composition was prepared by heating asphalt cement to 420° F. and adding 20% by weight of powdered devulcanized rubber. After a reaction time of thirty minutes, this material was sprayed at a rate of 0.5 gallon per square yard onto a portland cement treated soil base using a conventional asphalt distributor. The elastic membrane-like layer thus produced was immediately covered with crushed stone and rolled with a steel wheel roller to bond the stone to the membrane. A two inch layer of plant-mix asphalt concrete was then placed over the stone with a paving machine and rolled to produce the completed pavement.

When the membrane material used in this pavement was tested under tensile stress at 39.2° F., it was found that it would elongate by 650% without breaking while the untreated asphalt would withstand only 25% elongation. The elastic properties were determined by elongating a specimen to 150% of its original length under tensile stress at 77° F. and releasing the stress. The subsequent recovery in length was measured as elasticity. It was found that the rubberized membrane produced 95% recovery while the untreated asphalt had 0%.

This elasticity was demonstrated in the pavement containing the membrane where very few cracks were found after one year in place while the untreated asphalt was severely cracked.

EXAMPLE 2

A rubberized asphalt composition was prepared by blending asphalt cement with 3% of a styrene butadiene rubber latex contain 60% rubber solids at a temperature of 250° F. This material was sprayed onto a portland cement treated soil base at a rate of 0.3 gallon per square yard using a conventional asphalt distributor. The rubberized asphalt membrane-like layer was then covered with crushed stone and rolled with a steel wheel roller to bond the stone to the membrane. After allowing the membrane to set for twenty-four hours, a two inch layer of asphalt concrete was then placed over the stone with a paving machine and rolled to produce the completed pavement.

When the membrane material used in this pavement was tested under tensile stress at 39.2° F., it was found that it would elongate by 1100% without breaking while the untreated asphalt would withstand only 25% elongation. When the elastic properties of the membrane were tested as in Example 1, it produced a recovery of 90% compared with 0% in the untreated asphalt.

EXAMPLE 3

A hot rubberized asphalt composition was prepared by heating asphalt cement to 420° F., adding 23% by weight of ground vulcanized rubber produced from scrap tires, and cooking for one hour. The resulting material was squegeed onto a cracked portland cement treated soil base at a rate of 1.0 gallon per square yard. A coating of crushed stone was applied to the membrane-like layer and rolled while still hot to bond the stone to the membrane-like layer. A two inch layer of asphalt concrete was then placed over the stone with a paving machine and rolled to produce the finished pavement.

When the membrane material used in this pavement was tested under tensile stress at 39.2° F., it was found that it would elongate by 300% without breaking while the untreated asphalt would withstand only 25% elongation. When the elastic properties of the membrane-like layer were tested as in Example 1, it exhibited a recovery of 80% compared with 0% in the untreated asphalt.

We claim:

1. A process of surfacing a dirt roadway which comprises the steps of:

loosening the soil of the roadway and mixing it with portland cement and water and then compacting and setting the portland-cement-soil mixture to provide a portland-cement-stabilized soil roadbase, mixing 3–30wt% of particulate rubber with molten asphalt at a temperature of 200° to 450° F and spreading the resulting reaction product in fluent form over said portland-cement-stabilized solid roadbase at a rate of 0.3–1.0 gal. per square yard to form in situ an elastic membrane-like layer overlying said roadbase, and having an elongation in excess of 100% at 40° F without breaking and a recovery in excess of 75% after elongation to 150% of its original length under tensile stress at 77° F, spreading crushed mineral aggregate over said rubber-asphalt layer and rolling to form a protective layer, and applying over said protective layer an outer course of asphalt concrete having a thickness of at least 2 inches.

2. A process of surfacing a dirt roadway according to claim 1, in which the weight percentage of said rubber mixed with said molten asphalt is 20–30wt%.

3. A process of surfacing a dirt roadway according to claim 1, in which the rate at which said reaction product is spread on said portland-cement-stabilized soil roadbase is 0.5–1 gal. per square yard.

4. A process of surfacing a dirt roadway according to claim 1, in which said rubber mixed with said molten asphalt is non-oil-resistant rubber.

5. A dirt roadway surfacing comprising a portland-cement-stabilized soil roadbase comprising the product of portland cement and water mixed in situ with the soil of said roadway and compacted and set, an elastic membrane-like layer overlying said portland-cement-stabilized soil roadbase, said layer comprising the product of mixing 3–30wt% of particulate rubber with molten asphalt at a temperature of 200° to 450° F and spreading the resulting rubber-asphalt reaction product in fluent form over said portland-cement-stabilized soil roadbase, said elastic membrane-like layer having a thickness corresponding to 0.3–1.0 gal. of said rubber-asphalt reaction product per square yard of roadbase surface, and an elasticity permitting elongation in excess of 100% at 40° F without breaking and providing a recovery in excess of 75% after elongation to 150% of its original length under tensile stress at 77° F, a protective layer comprising a rolled layer of crushed mineral aggregate applied over said elastic membrane-like layer, and an outer course of asphalt concrete having a thickness of at least 2 inches applied over said protective layer.

6. A dirt roadway surfacing according to claim 5, in which said elastic membrane-like layer comprises the product of mixing 20–30wt% of said particulate non-oil-resistant rubber with said molten asphalt.

7. A dirt roadway surfacing according to claim 5, in which said elastic membrane-like layer has a thickness corresponding to 0.5–1.0 gal. of said rubber-asphalt reaction product per square yard of roadbase surface.

8. A dirt roadway surfacing according to claim 5, in which said rubber mixed with said molten asphalt is non-oil-resistant rubber.

* * * * *